US007367181B2

(12) United States Patent
Ameloot et al.

(10) Patent No.: US 7,367,181 B2
(45) Date of Patent: May 6, 2008

(54) SYSTEM FOR ASSISTING THE REGENERATION OF DEPOLLUTION MEANS INTEGRATED IN AN EXHAUST LINE OF A HEAT ENGINE

(75) Inventors: Piet Ameloot, Neuilly sur Seine (FR); Pascal Folliot, Guyancourt (FR)

(73) Assignee: Peugeot Citroen Automobiles SA, Velizy-Villacoublay (FR)

( * ) Notice: Subject to any disclaimer, the term of this patent is extended or adjusted under 35 U.S.C. 154(b) by 0 days.

(21) Appl. No.: 11/048,121

(22) Filed: Feb. 2, 2005

(65) Prior Publication Data

US 2005/0166591 A1 Aug. 4, 2005

(30) Foreign Application Priority Data

Feb. 3, 2004 (FR) ..... 04 01013

(51) Int. Cl.
*F01N 3/00* (2006.01)
*F02M 25/06* (2006.01)

(52) U.S. Cl. ..... 60/285; 60/295; 60/278

(58) Field of Classification Search ..... 60/280, 60/285, 295, 599
See application file for complete search history.

(56) References Cited

U.S. PATENT DOCUMENTS 4,465,051 A * 8/1984 Hasegawa ..... 123/486
4,984,456 A * 1/1991 Takahashi ..... 73/118.2
5,458,103 A * 10/1995 Lauvin ..... 123/456
5,661,972 A * 9/1997 Katoh et al. ..... 60/276
5,910,099 A * 6/1999 Jordan et al. ..... 60/599
6,053,144 A * 4/2000 Greenwood et al. ..... 123/294
6,128,899 A * 10/2000 Oono et al. ..... 60/295
6,253,545 B1 * 7/2001 Suzuki ..... 60/278
6,477,458 B1 * 11/2002 Yasui et al. ..... 701/109
6,588,210 B2 * 7/2003 Kreso ..... 60/602

FOREIGN PATENT DOCUMENTS

EP 0 994 243 A2 4/2000
EP 1 028 243 A2 8/2000
EP 1 193 383 A2 4/2002
EP 1 302 647 A2 4/2003

* cited by examiner

*Primary Examiner*—Thomas Denion
*Assistant Examiner*—Loren Edwards
(74) *Attorney, Agent, or Firm*—Nicolas E. Seckel

(57) ABSTRACT

The system for assisting the regeneration of depollution means (1) integrated in an exhaust line (2) of a heat engine (3) of a motor vehicle, by switching the engine between operation in lean mode and operation in rich mode in accordance with various parameters (7, 8) for controlling the operation of the engine, is characterized in that it comprises means (9) for measuring the temperature of the gases for supplying the engine and means (8) for correcting at least one parameter for controlling the operation of the engine in rich mode as a function of the measured temperature.

30 Claims, 1 Drawing Sheet

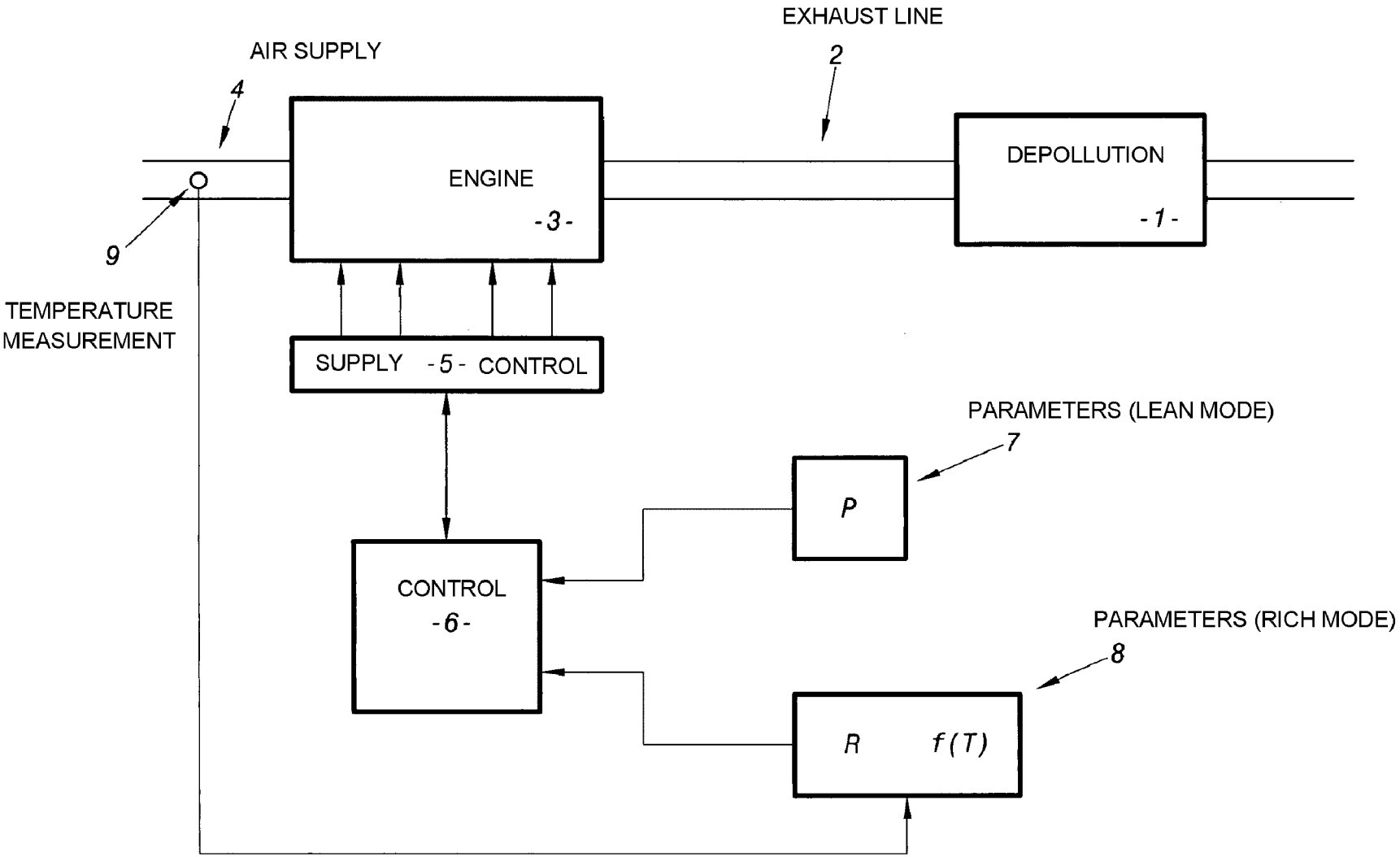
DEPOLLUTION
-1-
EXHAUST LINE
2
ENGINE
-3-
AIR SUPPLY
4
SUPPLY
-5- CONTROL
PARAMETERS (LEAN MODE)
7
P
PARAMETERS (RICH MODE)
8
R
f(T)
CONTROL
-6-
9
TEMPERATURE
MEASUREMENT

SYSTEM FOR ASSISTING THE REGENERATION OF DEPOLLUTION MEANS INTEGRATED IN AN EXHAUST LINE OF A HEAT ENGINE

TECHNICAL FIELD

The present invention relates to a system for assisting the regeneration of depollution means integrated in an exhaust line of a heat engine of a motor vehicle.

BACKGROUND OF THE INVENTION

It is known that such depollution means may comprise, for example, a NOx trap which is a system for reducing the polluting emissions of the heat engines of motor vehicles.

The engine is then associated with means for controlling its operation in order to switch it between standard operation in lean mode and regeneration operation in rich mode, in accordance with various parameters for controlling the operation of the engine.

In the standard operating mode in lean mode, the NOx trap stores the nitrogen oxides and, when the trap is saturated, its regeneration is triggered by switching the engine to rich operating mode, for the purpose of removing the NOx from the store, in which mode the engine produces reducing agents, such as, for example, CO and HC.

This is conventionally effected by modifying at least one parameter for controlling engine operation, that is to say, at least one parameter relating to the injection of fuel into the engine (quantity, phasing, pressure, etc. . . . ) and/or at least one parameter of the engine air supply loop (air flow rate, recycling, pressure of the turbocompressor, etc. . . . ).

The various adjustments to those parameters enable predetermined performance objectives in terms of torque, pollutant emissions, noise, etc. . . . to be achieved.

However, the calibration of the engine in rich operating mode is effected on the workbench under standard environmental conditions.

The object of the invention is to improve such a system in order to take into account variations in the environmental conditions.

SUMMARY OF THE INVENTION

To that end, the invention relates to a system for assisting the regeneration of depollution means integrated in an exhaust line of a heat engine of a motor vehicle, by switching the engine between operation in lean mode and operation in rich mode in accordance with various parameters for controlling the operation of the engine, characterized in that it comprises means for measuring the temperature of the gases for supplying the engine and means for correcting at least one parameter for controlling the operation of the engine in rich mode as a function of the measured temperature, and in that the means for measuring the temperature comprise a sensor for sensing the temperature of the compressed air between a compressor of a turbocompressor and an air-intercooler, which are associated with the engine.

The invention relates also to a system for assisting the regeneration of depollution means integrated in an exhaust line of a heat engine of a motor vehicle, by switching the engine between operation in lean mode and operation in rich mode in accordance with various parameters for controlling the operation of the engine, characterized in that it comprises means for measuring the temperature of the gases for supplying the engine and means for correcting at least one parameter for controlling the operation of the engine in rich mode as a function of the measured temperature, and in that the means for measuring the temperature comprise a sensor for sensing the temperature of the air upstream of a compressor of a turbocompressor associated with the engine.

The invention relates also to a system for assisting the regeneration of depollution means integrated in an exhaust line of a heat engine of a motor vehicle, by switching the engine between operation in lean mode and operation in rich mode in accordance with various parameters for controlling the operation of the engine, characterized in that it comprises means for measuring the temperature of the gases for supplying the engine and means for correcting at least one parameter for controlling the operation of the engine in rich mode as a function of the measured temperature, and in that the means for measuring the temperature comprise a sensor for sensing the temperature of the compressed air between an air-intercooler and the inlet for the recycling gases of the engine.

According to Other Features:

- the depollution means comprise a NOx trap;
- the means for measuring the temperature comprise a sensor for sensing the temperature in the environment of the vehicle;
- the temperature sensor is formed in a flow meter;
- the corrected parameter is a parameter for controlling the injection of fuel into the engine; and
- the corrected parameter is a parameter for controlling the air supply loop of the engine.

BRIEF DESCRIPTION OF DRAWING

The invention will be better understood on reading the following description which is given purely by way of example and with reference to the appended drawing which is a block diagram illustrating the structure and operation of a system in accordance with the invention.

DESCRIPTION OF PREFERRED EMBODIMENT

The FIGURE shows a system for assisting the regeneration of depollution means which are denoted by the general reference 1 in this FIGURE and which are integrated, for example, in an exhaust line 2 of a heat engine 3 of a motor vehicle.

The engine is also associated with air-supply means denoted by the general reference 4 and with means for controlling its supply of fuel, which are denoted by the general reference 5 and which comprise, for example, means having a common rail for supplying the injectors for injecting fuel into the engine cylinders.

The operation of those means is controlled by control means denoted by the general reference 6.

The depollution means comprise, for example, a NOx trap, and the control means 6 are in that case adapted to cause the operation of the engine to switch between operation in lean standard mode and operation in rich regeneration mode, in accordance with various parameters for controlling the operation thereof.

Those parameters are illustrated, for example, by references 7 and 8, respectively, in the FIGURE.

The parameters 7 are used to control the engine in lean operating mode while the parameters 8 are used to cause the engine to operate in rich regeneration mode.

In accordance with the invention, the system also comprises means for measuring the temperature of the gases for supplying the engine, which means are denoted by the general reference 9 in the FIGURE, and means for correcting at least one parameter for controlling the operation of the engine in rich mode, as a function of the measured temperature, in order to adapt that operation to the conditions encountered.

In accordance with the invention, the temperature of the gases for supplying the engine are taken into account in order to correct in rich mode one or more of the parameters for controlling the operation of the engine as a function of the actual temperature measured.

As has been indicated above, the parameter(s) may be one or more parameters for controlling the air supply loop of the engine, such as, for example, the air flow rate, the recycling of the exhaust gases, the pressure of the turbocompressor if the engine is associated with such a turbocompressor and/or one or more parameters for controlling the injection of fuel into the cylinders of the engine, such as, for example, the rate of flow, the phasing, or also the pressure, etc. . . .

The means for measuring the temperature may for their part be suitable for measuring the temperature of the ambient environment of the vehicle, as measured, for example, in the line for the admission of air into the engine, by way of a sensor placed, for example, upstream of the compressor, if the engine is associated with a turbocompressor, or elsewhere on the vehicle, such as, for example, in a rear view mirror thereof.

However, the sensor may also be suitable for measuring the temperature of the compressed air between the compressor and the intercooler for the air for supplying the engine, or also the temperature of the compressed air between the air-intercooler and the inlet where the recycling gases enter the engine.

This therefore permits correction of the parameters for controlling the operation of the engine in rich operating mode in order to optimize the regeneration stage of the depollution means.

The parameters 8 used may then be in the form of a preestablished map of values of the parameter(s) as a function of the temperature, enabling the corresponding parameter(s) to be obtained as a function of the measured temperature.

Of course, yet other embodiments may be envisaged.

Thus, for example, the means for measuring the temperature may be formed, for example, in a flow meter.

The invention claimed is:

1. System for assisting the regeneration of a NOx trap integrated in an exhaust line of a heat engine of a motor vehicle, by switching the engine between operation in lean fuel/air mixture standard mode with a first parameter tuning set being used to control the operation of the engine in lean mode and operation in rich fuel/air mixture regeneration mode with a second parameter tuning set being used to cause the engine to operate in rich mode, said system comprising:

means for measuring the temperature of the gases for supplying the engine, and means for correcting the tuning of at least one parameter among the parameters of the second parameter tuning set for controlling the operation of the engine in rich mode as a function of the measured temperature, in order to optimize a regeneration stage of the NOx trap, wherein said same correction is not applied to said at least one parameter in the first parameter tuning set for controlling the engine operation in lean mode, wherein the means for measuring the temperature comprise a sensor for sensing the temperature of the compressed air between a compressor of a turbocompressor and an air-intercooler, which are associated with the engine.

2. System according to claim 1, wherein the means for measuring the temperature comprise a sensor for sensing the temperature in the environment of the vehicle.

3. System according to claim 1, wherein the sensor for sensing the temperature is formed in a flow meter.

4. System according to claim 1, wherein the at least one corrected parameter is a parameter for controlling the injection of fuel into the cylinders of the engine.

5. System according to claim 1, wherein the at least one corrected parameter includes a parameter for controlling the air supply loop of the engine.

6. System according to claim 1, wherein the injectors are supplied by a common rail.

7. System according to claim 1, wherein the parameters of the first parameter tuning set used to control the engine operation in lean mode are not corrected as a function of the measured temperature.

8. System according to claim 1, wherein the second parameter tuning set used to control the engine operation in rich mode is in the form of a preestablished map of parameter values as a function of temperature.

9. System according to claim 1, wherein the at least one corrected parameter comprises a parameter for controlling the injection of fuel by the injectors into cylinders of the engine.

10. System for assisting the regeneration of a NOx trap integrated in an exhaust line of a heat engine of a motor vehicle, by switching the engine between operation in lean fuel/air mixture standard mode with a first parameter tuning set being used to control the operation of the engine in lean mode and operation in rich fuel/air mixture regeneration mode with a second parameter tuning set being used to cause the engine to operate in rich mode, said system comprising:

means for measuring the temperature of the gases for supplying the engine, and means for correcting the tuning of at least one parameter among the parameters of the second parameter tuning set for controlling the operation of the engine in rich mode as a function of the measured temperature, in order to optimize a regeneration stage of the NOx trap, wherein said same correction is not applied to said at least one parameter in the first parameter tuning set for controlling the engine operation in lean mode, wherein the means for measuring the temperature comprise a sensor for sensing the temperature of the compressed air between an air-intercooler and the inlet for the recycling gases of the engine.

11. System according to claim 10, wherein the means for measuring the temperature comprise a sensor for sensing the temperature in the environment of the vehicle.

12. System according to claim 10, wherein the sensor for sensing the temperature is formed in a flow meter.

13. System according to claim 10, wherein the at least one corrected parameter is a parameter for controlling the injection of fuel into the cylinders of the engine.

14. System according to claim 10, wherein the at least one corrected parameter includes a parameter for controlling the air supply loop of the engine.

15. System according to claim 10, wherein the injectors are supplied by a common rail.

16. System according to claim 10, wherein the parameters of the first parameter tuning set used to control the engine operation in lean mode are not corrected as a function of the measured temperature in lean mode.

17. System according to claim 10, wherein the second parameter tuning set used to control the engine operation in rich mode is in the form of a preestablished map of parameter values as a function of temperature.

18. System according to claim 10, wherein the at least one corrected parameter comprises a parameter for controlling the injection of fuel by the injectors into cylinders of the engine.

19. System for assisting the regeneration of a NOx trap integrated in an exhaust line of a heat engine of a motor vehicle, by switching the engine between operation in lean fuel/air mixture standard mode with a first parameter tuning set being used to control the operation of the engine in lean mode and operation in rich fuel/air mixture regeneration mode with a second parameter tuning set being used to cause the engine to operate in rich mode, said system comprising:

means for measuring the temperature of the gases for supplying the engine, and means for correcting the tuning of at least one parameter among the parameters of the second parameter tuning set for controlling the operation of the engine in rich mode as a function of the measured temperature, in order to optimize a regeneration stage of the NOx trap, wherein said same correction is not applied to said at least one parameter in the first parameter tuning set for controlling the engine operation in lean mode, wherein the means for measuring the temperature comprise a sensor for sensing the temperature of the compressed air upstream of a compressor of a turbocompressor associated with the engine.

20. System according to claim 19, wherein the means for measuring the temperature comprise a sensor for sensing the temperature in the environment of the vehicle.

21. System according to claim 19, wherein the sensor for sensing the temperature is formed in a flow meter.

22. System according to claim 19, wherein the injectors are supplied by a common rail.

23. System according to claim 19, wherein the parameters of the first parameter tuning set used to control the engine operation in lean mode are not corrected as a function of the measured temperature in lean mode.

24. System according to claim 19, wherein the second parameter tuning set used to control the engine operation in rich mode is in the form of a preestablished map of parameter values as a function of temperature.

25. System according to claim 19, wherein the at least one corrected parameter comprises a parameter for controlling the injection of fuel by the injectors into cylinders of the engine.

26. Method of assisting the regeneration of a NOx trap integrated in an exhaust line of a heat engine of a motor vehicle, comprising:

switching the engine between operation in lean fuel/air mixture standard mode with a first parameter tuning set being used to control the operation of the engine in lean mode and operation in rich fuel/air mixture regeneration mode with a second parameter tuning set being used to cause the engine to operate in rich mode, measuring the temperature of the gases for supplying the engine, by using a sensor for sensing the temperature of the compressed air in at least one of the following locations: (i) between a compressor of a turbocompressor and an air-intercooler, which are associated with the engine, (ii) upstream of a compressor of a turbocompressor associated with the engine, and (iii) between an air-intercooler and the inlet for the recycling gases of the engine, and correcting the tuning of at least one parameter among the parameters of the second parameter tuning set for controlling the operation of the engine in rich mode as a function of the measured temperature, in order to optimize a regeneration stage of the NOx trap, wherein said same correction is not applied to said at least one parameter in the first parameter tuning set for controlling the engine operation in lean mode.

27. Method according to claim 26, wherein the injectors are supplied by a common rail.

28. Method according to claim 26, wherein the parameters of the first parameter tuning set used to control the engine operation in lean mode are not corrected as a function of the measured temperature in lean mode.

29. Method according to claim 28, wherein the second parameter tuning set used to control the engine operation in rich mode is in the form of a preestablished map of parameter values as a function of temperature.

30. Method according to claim 26, wherein the at least one corrected parameter comprises a parameter for controlling the injection of fuel by the injectors into cylinders of the engine.

* * * * *